US006200130B1

(12) United States Patent
Man

(10) Patent No.: US 6,200,130 B1
(45) **Date of Patent: *Mar. 13, 2001**

(54) CHILD RESISTANT PIEZO-ELECTRIC SAFETY LIGHTER

(76) Inventor: Aman Chung Kai Man, Unit 1, 11/F, Wah Lai Ind. Centre, 10-14 Kwei Tei Street Fo Tan, Shatin, N.T. (HK)

( * ) Notice: Subject to any disclaimer, the term of this patent is extended or adjusted under 35 U.S.C. 154(b) by 0 days.

This patent is subject to a terminal disclaimer.

(21) Appl. No.: 09/456,750

(22) Filed: Dec. 6, 1999

Related U.S. Application Data

(63) Continuation of application No. 09/163,023, filed on Sep. 29, 1998, now Pat. No. 5,997,282.

(51) Int. Cl.[7] ..... F23Q 2/28
(52) U.S. Cl. ..... 431/153; 431/255
(58) Field of Search ..... 431/153, 255

(56) References Cited

U.S. PATENT DOCUMENTS 4,904,180 * 2/1990 Nitta ..... 431/153
5,145,358 * 9/1992 Shike et al. ..... 431/153
5,324,193 * 6/1994 Pan ..... 431/153
5,462,432 * 10/1995 Kim ..... 431/153
5,829,963 * 11/1998 Ichikawa ..... 431/153
5,839,892 * 11/1998 Hwang ..... 431/153
6,086,358 * 7/2000 Potskhishvili et al. ..... 431/153

* cited by examiner

*Primary Examiner*—Ira S. Lazarus
*Assistant Examiner*—Sara Clarke
(74) *Attorney, Agent, or Firm*—Trojan Law Offices

(57) ABSTRACT

A child resistant lighter comprising a standard piezo-electric lighter construction having a main body, a fuel reservoir, valve release means, and a piezo-electric means, the improvement comprising a child-resistant safety device which includes a safety button which must be moved to an engaged position so that a contacting block will be in place when the operating button is depressed allowing contact and displacement of the release lever which will open the gas valve and allow operation of the lighter.

5 Claims, 3 Drawing Sheets

CHILD RESISTANT PIEZO-ELECTRIC SAFETY LIGHTER

RELATED PATENT APPLICATIONS

This is a continuation application of Ser. No. 09/163,023, filed Sep. 29, 1998 now U.S. Pat. No. 5,997,282.

FIELD OF THE INVENTION

This invention relates to child-resistant lighters.

BACKGROUND OF THE INVENTION

Various prior art cigarette lighters incorporating safety features are known. Safety features are generally provided to reduce the risk of injury to an operator or bystanders. Safety features for cigarette lighters can be divided into several general categories. Some safety mechanisms prevent ignition of a fuel source unless the lighter is properly oriented. Other mechanisms have been designed to automatically turn off a fuel supply valve. More recently, attention has been directed toward preventing ignition of the lighters by children and other persons normally not able to appreciate the danger of fire. Individuals usually considered in these efforts are young children, age five years and younger.

Child tamper-resistant mechanisms have focused on preventing depression of the thumb pad or thumb actuator found in most lighters by incorporating a locking mechanism that physically blocks the downward movement of the thumb pad unless a safety latch or other button is first engaged to unlock the lighter. However, none of the prior inventions have incorporated a device which allows deflection of the operating button but not the gas release lever. The invention presented here, incorporates a safety button which must be moved to an engaged position and held there during displacement of the operating button. The operating button may be displaced whether the safety button is engaged or not, but the lighter will only release combustible fuel when the safety button is engaged during displacement of the operating button.

This additional step in the normal operation of a piezo-electric lighter will reduce the possibility of use by children. Children may not comprehend the need to move the safety button to its engaged position an maintain this position during depression of the operating button. As such, it is likely that a child will at best depress the operating button without the safety button in an engaged position, with will in turn, not deflect the release lever. Even if a child understands the operation of the child-resistant button device, he/she may not have the strength or manual dexterity to operate the safety button while depressing the operating button.

SUMMARY OF THE INVENTION

The present invention is directed to a child-resistant lighter which incorporates a safety button which must be moved to an engaged position and held there during displacement of the operating button. The operating button may be displaced whether the safety button is engaged or not, but the lighter will only release combustible fuel when the safety button is engaged during displacement of the operating button.

Likewise, the invention is intended to add additional analytical steps to the child's mental process of understanding the operation of the lighter to further hinder the ability of small children to use the lighter.

These and other objects and advantages of the present invention will become apparent from the following detailed description of the preferred embodiment of the invention without intending to limit the scope of the invention which is set forth in the appended claims.

DETAILED DESCRIPTION OF THE DRAWINGS

The advantages of the invention can be more clearly understood by reference to the drawings in which.

DETAILED DESCRIPTION OF THE PREFERRED EMBODIMENT

Figure 1:
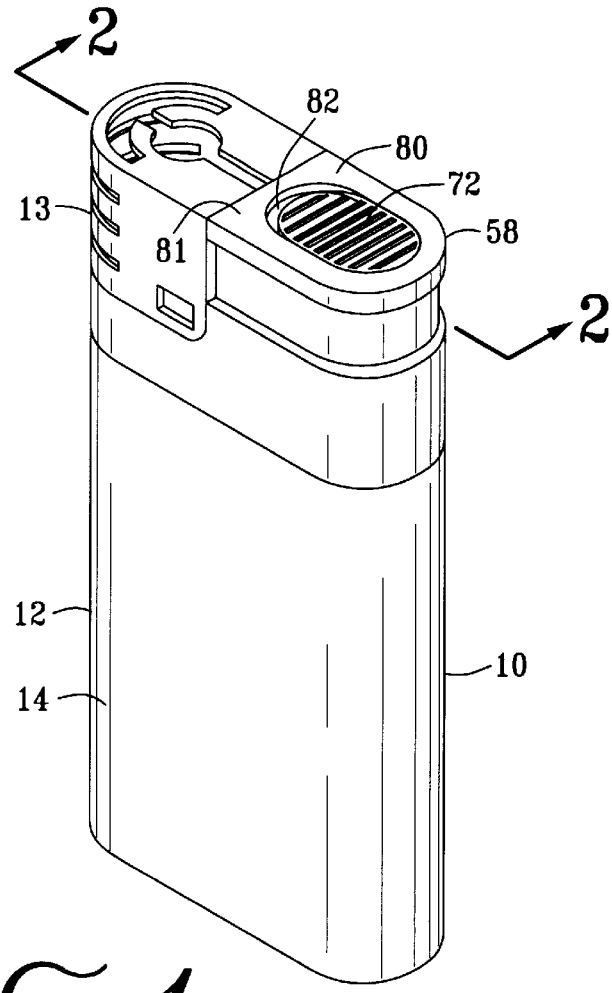
FIG. 1 is a perspective view of the invention.
Figure 2:
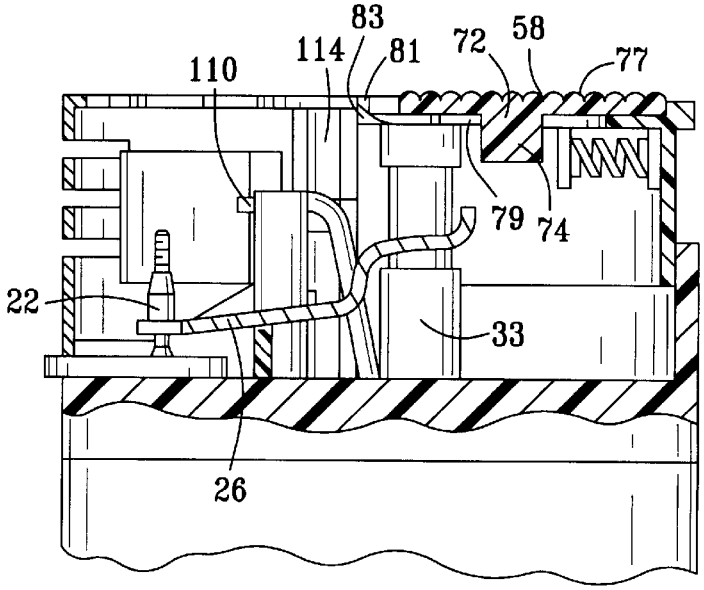
FIG. 2 is a side cross-sectional view of the invention with the operating button and the safety button both in their respective initial positions.

FIGS. 1 through 6, inclusive, generally illustrate the present invention 10, a child resistant piezo-electric safety lighter, in one of its preferred embodiments. The lighter 10 includes a main housing 12, which contains a standard fuel reservoir 14. The main housing 12 also includes a top end 13 from which support arms 15 project longitudinally.

The top end 13 of the lighter 10 also generally incorporates a piezo-electric ignition mechanism 33 secured thereto. As shown in FIGS. 1 through 6, the ignition mechanism includes any standard means for the controlled release of a combustible fuel from reservoir 14. The fuel release means may include a valve 22 connected to a tube (not shown) that draws on fuel in the reservoir 14. The valve 22 is typically moved to the open position by operation of a release lever 26. The release lever 26 has an interior end 28 and an exterior end 30. The interior end 28 has a prong 32 formed therein for engaging the valve 22. The exterior end 30 has an area for contacting a depression mechanism. The release lever 26 also includes hinging means (not shown), mounted to top end 13 thereby permitting lever 26 to pivot when in operation. A standard flame regulator 106 is mounted to top end 13 and positioned and shaped to control airflow and maintain position of a flame. A standard wind screen 38 fits over and encloses the valve 22 and a portion of the support arms 15. Release lever 26 allows selective actuation between a normally closed valve 22 position, which prevents exit of said combustible fuel from said reservoir 14, and an open position which permits exit of combustible fuel from reservoir 14 through valve 22. Release lever 26 being pivotally mounted so that the exterior end 30 may be deflected by depression of child-resistance safety device 58.

The new and novel improvement of the present invention is the addition of child-resistance safety device 58. Child-resistance safety device 58 comprising operating button 80 and safety button 72. This safety device operates as a child-resistance safety mechanism by requiring the user to move forward safety button 72 to, and maintain it in, an engaged position before and during depressing the operating button 80. Without safety button 72 in its engaged position during depression of operating button 80 release lever 26 will not be displaced and valve 22 will not open to release the combustible fuel. This additional step in the normal operation of a piezo-electric lighter will reduce the possibility of use by children. Children may not comprehend the need to move safety button 72 to its engaged position an maintain this position during depression of operating button 80. As such, it is likely that a child will at best depress operating button 80 without safety button 72 in an engaged position, which will in turn, not deflect release lever 26. Even if a child understands the operation of child resistance safety device 58, it may not have the strength or manual dexterity to operate safety button 72 while depressing operating button 80. Operating button 80 is mount ed to lighter housing 12 to allow vertical sliding, having an initial position above a lower depressed position. Operating button 80 is positioned s to contact and cause actuation of the piezo-electric means 33 for causing a spark. In turn, the piezo-electric means is mounted to said lighter housing in operational relation with said operating button such that when said operating button is transversed from its initial position to its depressed position the piezo-electric means will cause a spark to be formed between its cathode 110 and its anode (not shown). Cathode 110 and the anode being positioned in a spaced relation to facilitate formation of a spark at or near said valve 22 for ignition of the combustible fuel Operating button 80 has an upper surface 81 and a lower surface 83. Upper surface 81 and lower surface 83 defining a predetermined thickness of said operating button. Also, operating button 80 has a front end and a rear end. Mounting of operating button 80 is done via a pair of opposed vertical rails 114, which allow operating button 80 to slide vertically. Vertical rails 114 are mounted to the support arms 15 of lighter housing 12. Operating button 80 being positioned above said release lever 26 such that when operating button 80 is transversed from its initial position to its depressed position, the lower surface 83 will come to rest at a position less than necessary to contact and deflect the exterior end 30 of release lever 26 to an extent necessary to open valve 22. As such, preventing release of the combustible fuel and prohibiting operation of lighter 10.

A portion of upper surface 81 is shaped to define an elongated recess 82 running from the front to the rear of the upper surface 81. Further, upper surface 81 contains a pair of pass-through slots 84 positioned within recess 82 and aligned front to rear of operating button 80.

Figure 3:
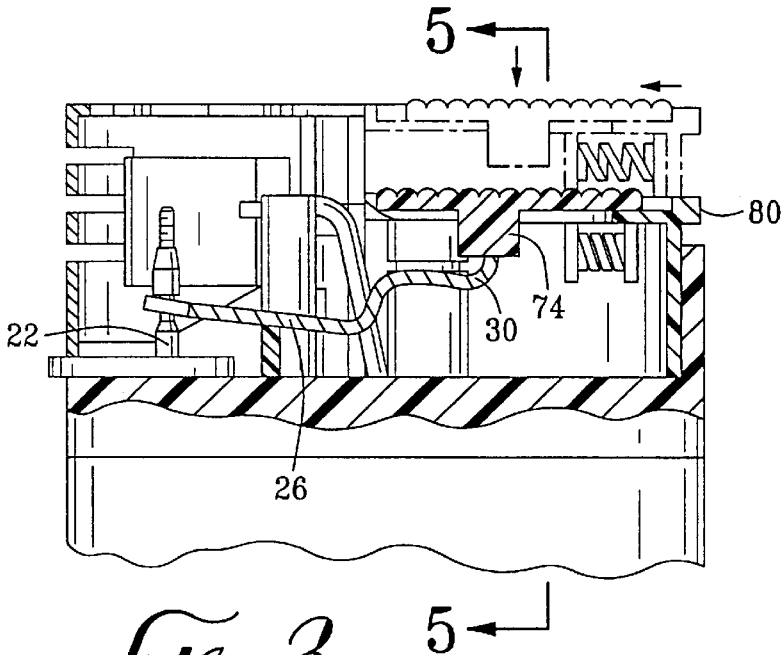
FIG. 3 is a side cross-sectional view of the invention with the operating button in its deflected position and the safety button in its engaged position so that the gas release lever will be deflected to cause opening of the gas valve and allow operation of the lighter.
Figure 5:
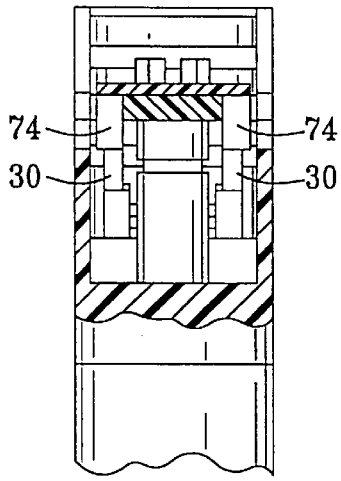
FIG. 5 is a rear cross sectional view of the invention showing the operating button fully depressed with the safety button in its engaged position so as to contact and deflect the gas release lever.
Figure 4:
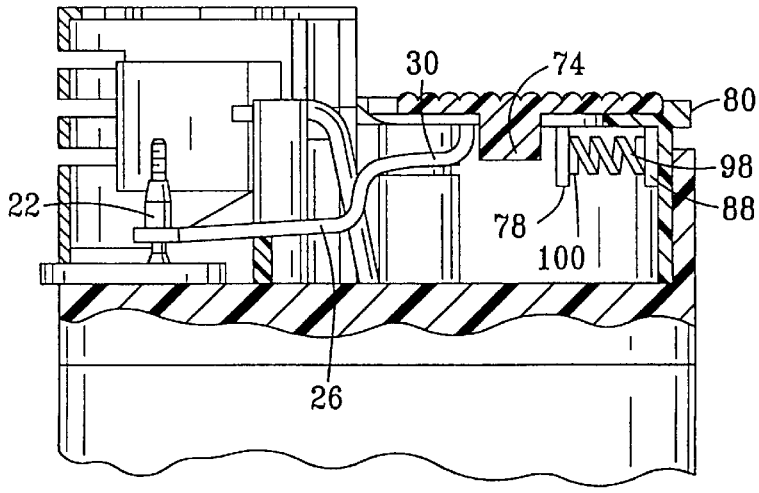
FIG. 4 is a side cross-sectional view of the invention with the operating button in its deflected position and the safety button in its non-engaged position so that the gas release lever can not be deflected and the gas valve will not be opened so that the lighter will not be capable of operating.
Figure 6:
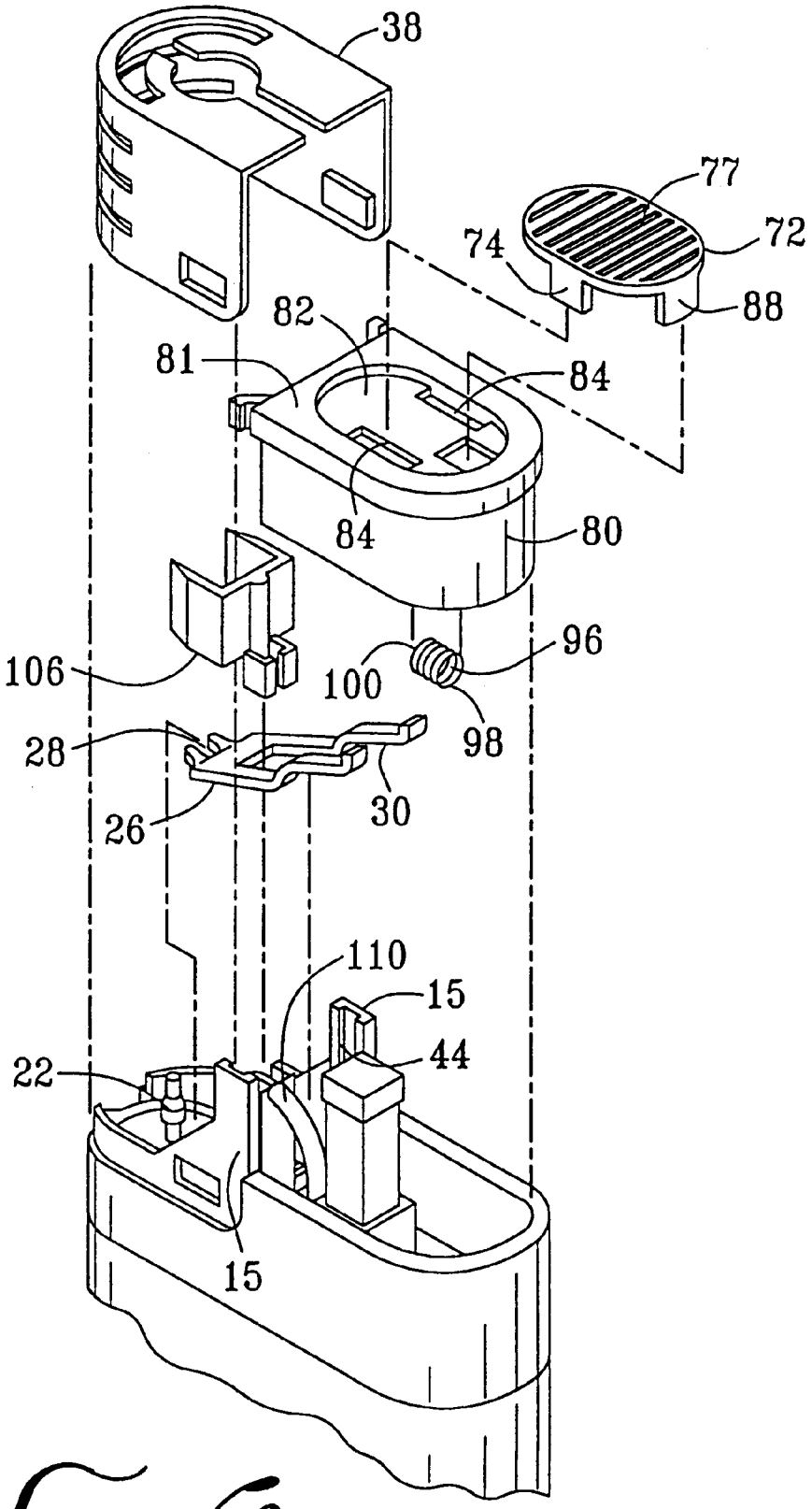
FIG. 6 is an exploded view of the invention.

A safety button 72 has a top 77 and bottom surface 79. Safety button 72 is slidably mounted within recess 82 and positioned as to be actuatable by an user. Safety button 72 is sized to freely slide within recess 82 from its initial position to its engaged position. A pathway is defined by the translation of safety button 72 between its initial and engaged positions. A pair of contact blocks 74 depend downward from the bottom 79 of safety button 72 a predetermined length. The contact blocks 74 are sized to pass through slots 84, and shaped and located so that in the initial position of safety button 72, as shown in FIG. 4, the contacting blocks 74 are positioned so that when operating button 80 is transversed to its depressed position the contacting blocks 74 pass by the exterior end 30 of release lever 26 so that release lever 26 remains stationary. Likewise, as shown in FIGS. 3 and 5, with safety button 72 in its engaged position, the contacting blocks 74 are positioned so that when operating button 80 is depressed the contacting blocks 74 contact the exterior end 30 of the release lever 26 causing release lever 26 to translate with operating button 80 a distance sufficient to cause opening of said valve 22.

The child-resistance safety device 58 further comprises a horizontally mounted spring 96 having a first end 98 and a horizontally opposed second end 100. Spring 96 is biased between safety button 72 and operating button 80 to cause safety button 72 to return to its initial position upon displacement therefrom. First end 98 is received by spring prong 88 which depends from the lower surface 83 of safety button 72. Positioned opposing and in operating relation to spring prong 88 is spring prong 78. Spring prong 78 receives second end 100 of spring 96. Spring prong 78 depends downward from operating button 80. Spring 96 is held in compression between the spring prong 78 and spring prong 88 such that spring 96 applies an equal and opposite force to each such prong causing safety button 72 to be returned to its initial position upon any displacement therefrom.

The exterior end 30 of release lever 26 is Y-shaped having two ends opposite to valve 22 which are positioned to receive each contact block 74 of safety button 72.

The top surface 77 of safety button 72 may comprise a non-slip surface for receiving and preventing slippage of the users thumb.

Although the present invention has been described in considerable detail with reference to certain preferred versions thereof, other versions are possible. Therefore, the spirit and scope of the appended claims should not be limited to the description of the preferred versions contained herein.

What is claimed is:

1. A child-resistant piezo-electric lighter having a lighter housing defining a reservoir for containing a combustible fuel, a fuel release means, in communication with the reservoir, including a valve cooperating with a release lever for selective actuation between a normally closed valve position which prevents exit of the combustible fuel from the reservoir, and an open position which permits exit of combustible fuel from the reservoir through the valve, the release lever being pivotally mounted so that a first end, opposite to the valve, when deflected, moves the valve into the open position, an operating button being slidably mounted to the lighter housing and having a starting position and a depressed position, and positioned so as to contact and cause actuation of the release lever and a piezo-electric unit for generating a spark, the piezo-electric unit being mounted to the lighter housing in operational relation with the operating button such that when the operating button is transversed from its starting position to its depressed position the piezo-electric unit generates a spark, the piezo-electric unit positioned in a spaced relation to facilitate formation of a spark at or near the valve for ignition of the combustible fuel when the valve is in the open position, the child-resistant device comprising:

a safety button being slidably mounted on the operating button as to be actuatable by a user, the safety button having an initial position, an engaged position, and a contact block, the contact block being sized and located such that when the safety button is in the initial position the contact block and the first end of the release lever are not aligned and when the safety button is in the engaged position the contact block and the first end of the release lever are aligned, when the contact block and the first end of the release lever are not aligned, depression of the operating button only causes the piezo-electric unit to generate a spark, when the contact block and the first end of the release lever are aligned, depression of the operating button causes the contact block to engage the first end of the release lever and deflect the release lever actuating the valve into the open position and causes the piezo-electric unit to generate a spark.

2. The child-resistant piezo-electric lighter as in claim 1, further comprising a resilience means biased between the operating button and the safety button, for slidably returning said safety button to its initial position upon displacement therefrom.

3. The child-resistant piezo-electric lighter as in claim 2, wherein said resilience means is a spring.

4. The child-resistant piezo-electric lighter as in claim 3, wherein said safety button further comprises an additional contact block, said contact blocks opposingly mounted on the safety button.

5. The child-resistant piezo-electric lighter as in claim 1, wherein the safety button further comprises a top side, the top side having a non-slip surface for receiving and preventing slippage of a user's thumb.

* * * * *